US005354192A

United States Patent [19]

Soejima et al.

[11] Patent Number: 5,354,192

[45] Date of Patent: Oct. 11, 1994

[54] INDIRECT EXTRUSION PRESS

[75] Inventors: Munenori Soejima; Kazutaka Uehara, both of Kobe, Japan

[73] Assignee: Kabushiki Kaisha Kobe Seiko Sho, Kobe, Japan

[21] Appl. No.: 973,978

[22] Filed: Nov. 9, 1992

[30] Foreign Application Priority Data

Nov. 14, 1991 [JP] Japan ..... 3-299156

[51] Int. Cl.[5] ..... B21C 23/00; B29C 47/00

[52] U.S. Cl. ..... 425/190; 72/273; 72/273.5; 425/227; 425/376.1

[58] Field of Search ..... 72/255, 263, 273, 273.5; 425/186, 188, 190, 225, 227, 231, 376.1

[56] References Cited

U.S. PATENT DOCUMENTS

| | | | |
|---|---|---|---|
| 3,543,300 | 11/1970 | Valks | 72/263 |
| 3,798,953 | 3/1974 | Sgambati et al. | 72/263 |
| 3,919,870 | 11/1975 | Wassen et al. . | |
| 3,977,226 | 8/1976 | Mann et al. | 72/273 |
| 4,056,964 | 11/1977 | Shibasaki et al. | 72/273 |
| 4,223,546 | 9/1980 | Wagner et al. . | |
| 4,342,212 | 8/1982 | Sibler | 72/263 |
| 4,402,208 | 9/1983 | Sibler | 72/263 |
| 4,424,696 | 1/1984 | Asari et al. . | |
| 4,430,877 | 2/1984 | Asari et al. . | |
| 4,459,837 | 7/1984 | Hayashi et al. | 72/273.5 |
| 4,463,589 | 8/1984 | Asari et al. . | |
| 4,798,528 | 1/1989 | Hattori et al. | 425/190 |

FOREIGN PATENT DOCUMENTS

| | | | |
|---|---|---|---|
| 1452341 | 2/1969 | Fed. Rep. of Germany | 72/255 |
| 10044 | of 1891 | United Kingdom | 425/188 |

*Primary Examiner*—Charles S. Bushey

*Attorney, Agent, or Firm*—Oblon, Spivak, McClelland, Maier & Neustadt

[57] ABSTRACT

An indirect extrusion press wherein a cleaning ring can be clamped with certainty by clamp members. The indirect extrusion press has a die stem, a container, a cleaning ring removably fitted at an end portion of the die stem for cleaning the inner face of the container, a loose die removably mounted at the end of the die stem, and a handling apparatus including first and second pairs of clamp members for clamping therebetween and handling the cleaning ring and the loose die, respectively. The cleaning ring has a circumferential groove formed on an outer periphery thereof. Each of the first pair of clamp members for clamping the cleaning ring therebetween has a projection formed thereon for engaging the circumferential groove of the cleaning ring.

6 Claims, 6 Drawing Sheets

INDIRECT EXTRUSION PRESS

BACKGROUND OF THE INVENTION

1. Field of the Invention

This invention relates to an indirect extrusion press which includes a cleaning ring and a loose die, and more particularly to a clamp mechanism of the indirect extrusion press of the type mentioned which clamps the cleaning ring upon handling.

2. Description of the Related Art

An indirect extrusion press for use for indirect extrusion of aluminum alloy material is already known and disclosed, for example, in Japanese Utility Model Publication Application No. 61-42649.

The indirect extrusion press is shown in FIG. 8. Referring to FIG. 8, the indirect extrusion press includes a cleaning ring 3 removably fitted at an end portion of a die stem 1 and adapted to clean the inner face of a container 2. A loose die 4 is removably mounted at the end of the die stem 1, and a handling apparatus 5 is provided for clamping and handling the cleaning ring 3 and the loose die 4.

After indirect extrusion of material, the cleaning ring 3 and the loose die 4 at the end of the die stem 1 are protruded outwardly from an adjacent end of the container 2, clamped by clamp members of the handling apparatus 5 and removed in an axial direction from the die stem 1 by the handling apparatus 5.

The prior art indirect extrusion press, however, has a drawback that, since the cleaning ring 3 has a small axial dimension and has a cylindrical outer periphery of a uniform diameter, when it is to be pulled off from the die stem 1 after it is clamped by the clamp members of the handling apparatus 5, the clamp members are liable to slip on the cleaning ring 3 so that they fall to clamp the cleaning ring 3, which makes it impossible to perform an intended operation.

SUMMARY OF THE INVENTION

It is an object of the present invention to provide an indirect extrusion press wherein a cleaning ring can be clamped with certainty by clamp members.

In order to attain the object, according to the present invention, there is provided an indirect extrusion press, which comprises a die stem, a container, a cleaning ring removably fitted at an end portion of the die stem for cleaning the inner face of the container, a loose die removably mounted at the end of the die stem, and a handling apparatus including first and second pairs of clamp members for clamping therebetween and handling the cleaning ring and the loose die, respectively, the cleaning ring having a circumferential groove formed on an outer periphery thereof, each of the first pair of clamp members for clamping the cleaning ring therebetween having a projection formed thereon for engaging the circumferential groove of the cleaning ring.

With the indirect extrusion press, after indirect extrusion, the cleaning ring and the loose die are clamped by the first and second pairs of clamp members of the handling apparatus and then removed in the axial direction from the die stem. Thereupon, the projections of the first pair of clamp members are engaged with the circumferential groove formed on the outer periphery of the cleaning ring. Consequently, the cleaning ring is clamped with certainty by and between the first pair of clamp members, thereby preventing otherwise possible failure in clamping.

Preferably, the indirect extrusion press further comprises a letting off plate mounted on a side face of each of the first pair of clamp members remote from the loose die for engaging an end face of the cleaning ring. When the cleaning ring is removed from the die stem, the cleaning ring is pushed by the letting off plates. Consequently, an otherwise possible slip of the clamp members on the cleaning ring is prevented, and consequently, the burden to the clamp members can be reduced.

The above and other objects, features and advantages of the present invention will-become apparent from the following description and the appended claims, taken in conjunction with the accompanying drawings in which like parts or elements are denoted by like reference characters.

DETAILED DESCRIPTION OF THE PREFERRED EMBODIMENTS

Figure 1:
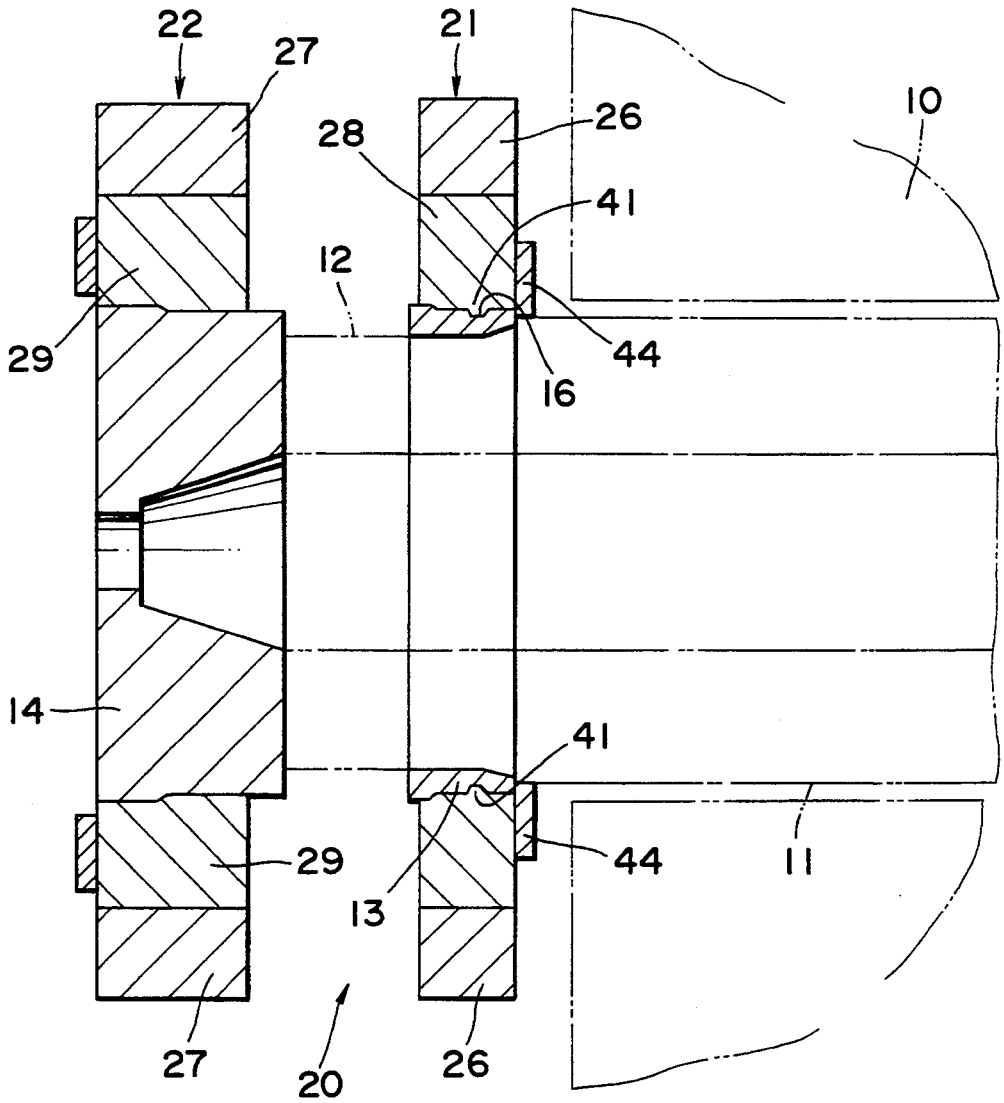
FIG. 1 is a partial front elevational sectional view of a clamp mechanism of an indirect extrusion press showing a first preferred embodiment of the present invention.
Figure 2:
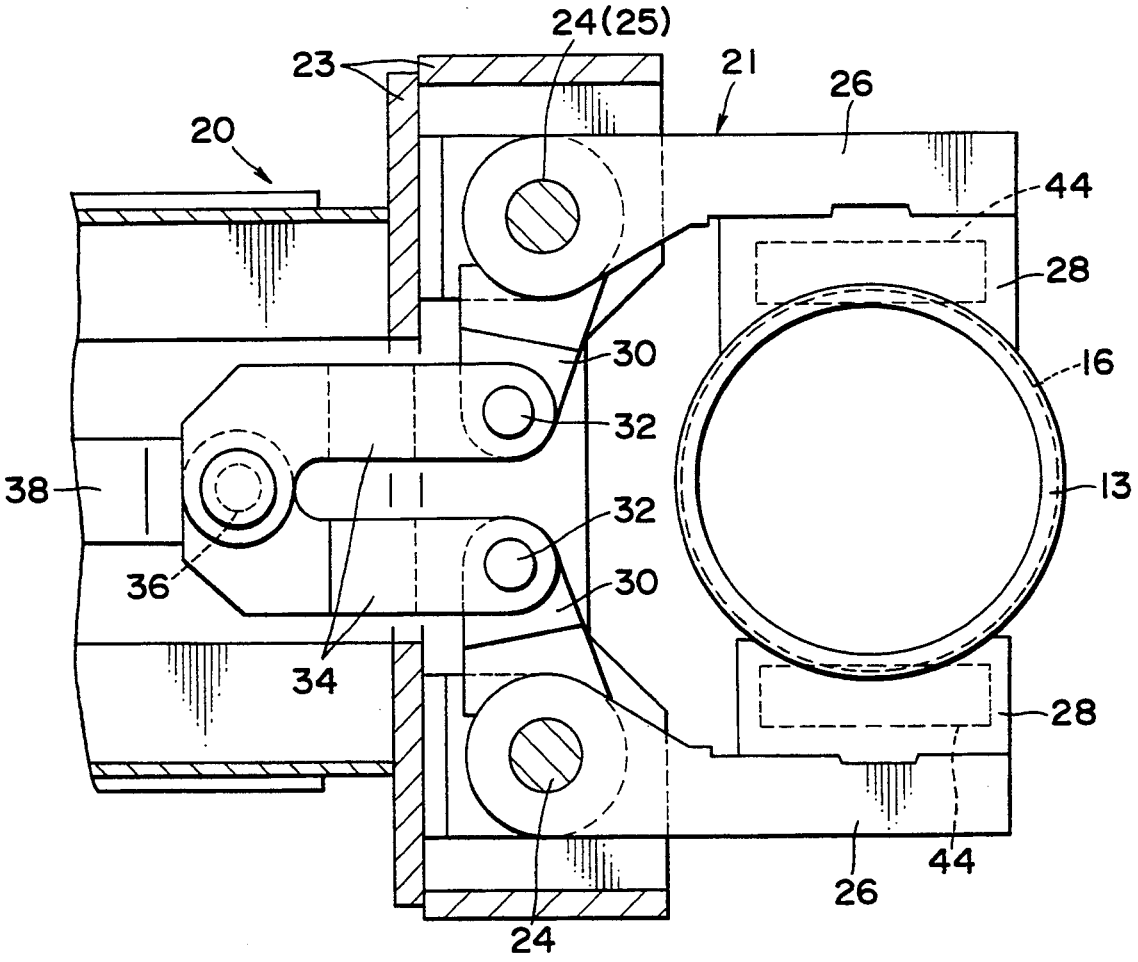
FIG. 2 is a partial side elevational sectional view of the clamp mechanism of FIG. 1.
Figure 3:
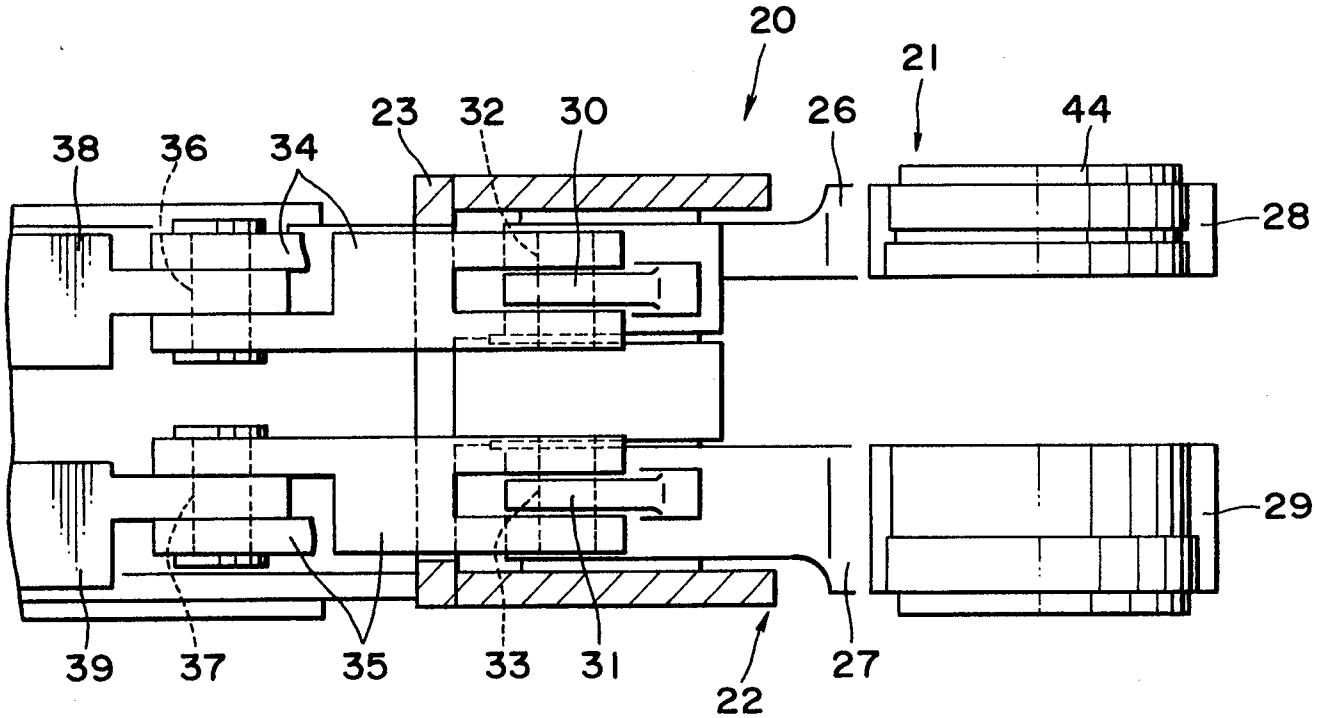
FIG. 3 is a partial horizontal sectional top plan view showing, in a reduced scale, the clamp mechanism of FIG. 1.

Referring first to FIGS. 1 to 3, there is shown an indirect extrusion press to which the present invention is applied. The indirect extrusion press includes a container 10, a cylindrical die stem 11, and a cleaning ring 13 removably fitted at an end portion of an outer periphery of a reduced diameter portion 12 at an end portion of the die stem 11 and adapted to clean the inner face of the container 10. A loose die 14 is removably mounted at the end of the die stem 11.

Figure 4:
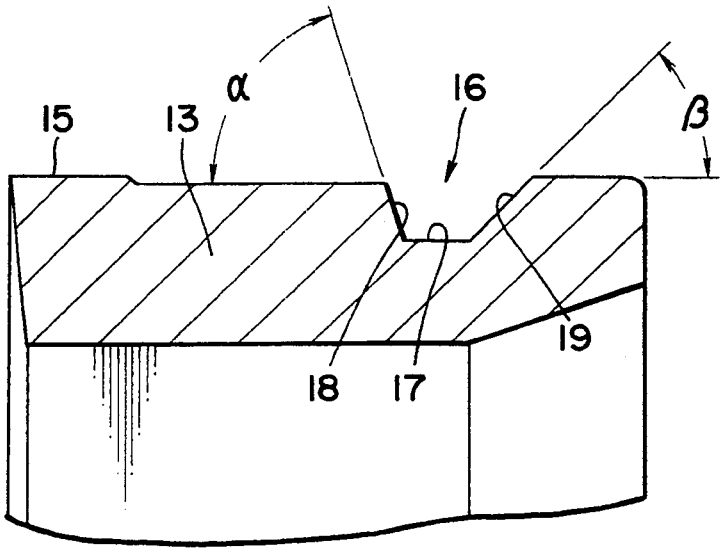
FIG. 4 is an enlarged sectional view of a cleaning ring of the indirect extrusion press shown in FIG. 1.

Referring to FIG. 4, a cleaning portion 15 for scratching off shells on the inner face of the container 10 is provided at an end of an outer periphery of the cleaning ring 13 in an axial direction, and a circumferential groove 16 is formed at a portion of the outer periphery of the cleaning ring 13 displaced from a central portion in the axial direction opposite to the cleaning portion 15.

The circumferential groove 16 has a tapered profile having a pair of inclined faces 18 and 19 on the opposite sides of a bottom 17 thereof, and the inclined face 18 adjacent the cleaning portion 15 is set so as to have an inclination angle $\alpha=75°$, and the opposite inclined face 19 is set so as to have an inclination angle $\beta=45°$.

Referring back to FIGS. 1 to 3, the indirect extrusion press further includes a handling apparatus 20 for handling, after indirect extrusion of a material, the cleaning ring 13 and the loose die 14. The handling apparatus 20 includes a frame 23, a ring clamp mechanism 21 for the cleaning ring 13 and a die clamp mechanism 22 for the loose die 14.

Each of the clamp mechanisms 21 and 22 includes a pair of upper and lower clamp arms 26 or 27 supported each for pivotal motion on the frame 23 by way of a pivot shaft 24 or 25, a pair of upper and lower clamp members 28 or 29 mounted at end portions of the clamp arms 26 or 27, a pair of operating arms 30 or 31 extending in the opposite upward and downward directions from base portions of the clamp arms 26 or 27, a pair of links 34 or 35 connected to the operating arms 30 or 31 each by means of a pin 32 or 33, and a connecting link 38 or 39 to which the links 34 or 35 are connected by way of a pin 36 or 37.

Each of the connecting links 38 and 39 is connected to a clamping hydraulic cylinder not shown so that, when the hydraulic cylinder makes an expanding or contracting movement, the clamp arms 26 or 27 of the clamp mechanism 21 or 22 are opened or closed around the pivot shafts 24 or 25, and when the hydraulic cylinder makes a contracting movement, the cleaning ring 13 or the loose die 14 is clamped by the clamp members 28 or 29.

Figure 5:
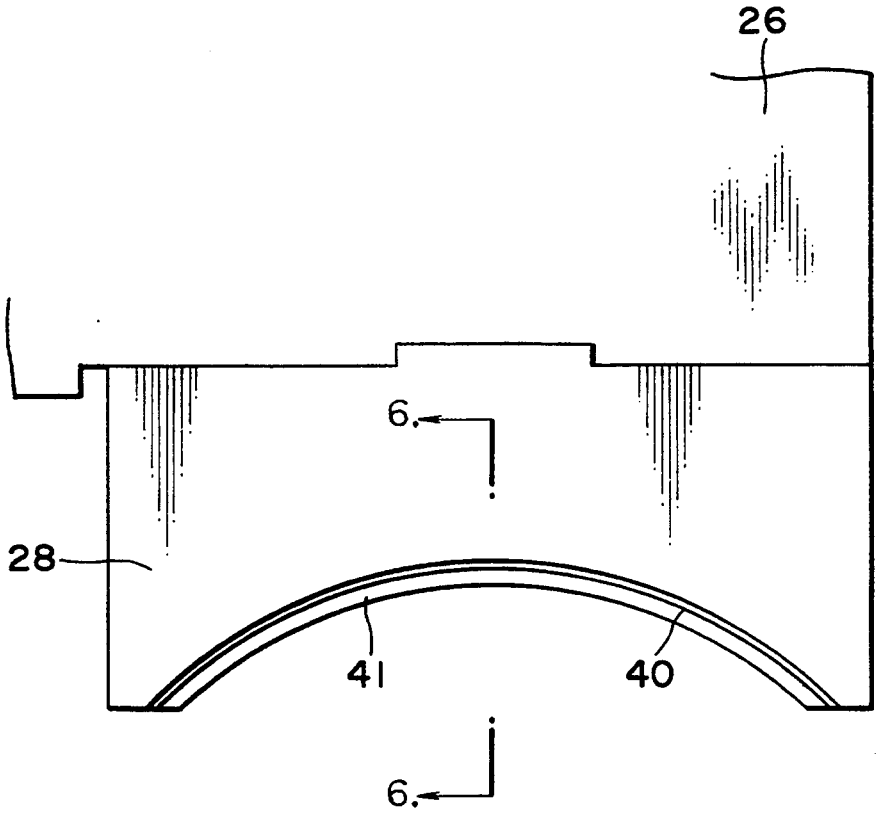
FIG. 5 is an enlarged side elevational view of a clamp member of the clamp mechanism of FIG. 1.
Figure 6:
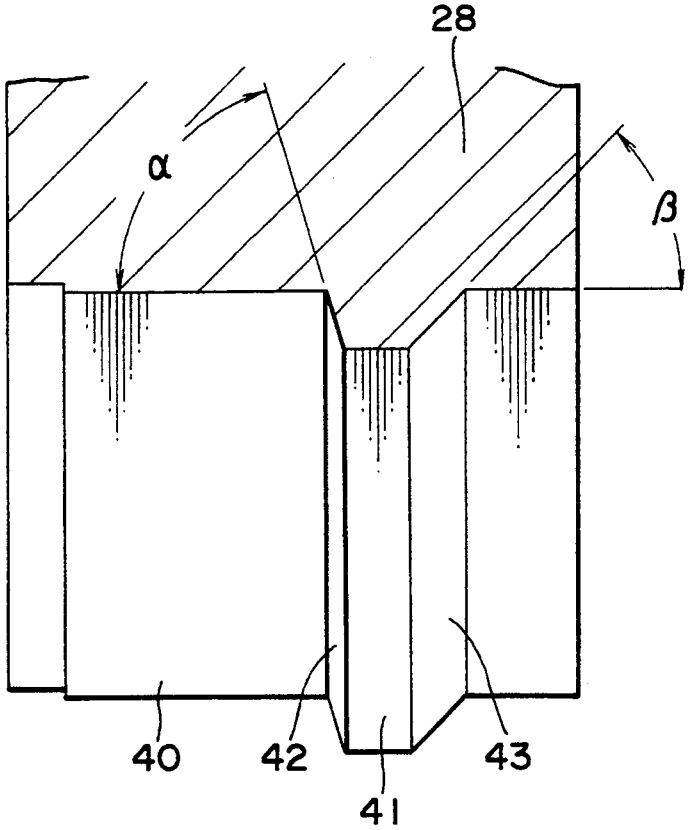
FIG. 6 is an enlarged sectional view taken along line A—A of FIG. 5.

Referring to FIGS. 5 and 6, each of the clamp members 28 of the ring clamp mechanism 21 has a clamp face 40 formed thereon such that it is recessed circumferentially along the outer peripheral face of the cleaning ring 13, and an inward projection 41 for engaging the circumferential groove 16 of the cleaning ring 13 upon clamping and formed over the overall length of the clamp face 40 in the circumferential direction.

The projection 41 is formed in a trapezoidal shape of an asymmetrical section having a pair of inclined faces 42 and 43 which are inclined at the inclination angles $\alpha$ and $\beta$ equal to those of the corresponding inclined faces 18 and 19, respectively, of the circumferential groove 16 of the cleaning ring 13.

Referring back to FIGS. 1 to 3, a letting off preventing plate 44 is mounted on a side face of each of the clamp members 28 remote from the loose die 14 such that it may engage with an axial end face of the cleaning ring 13.

In the indirect extrusion press having such construction as described above, after indirect extrusion, the cleaning ring 13 and the loose die 14 are clamped from above and below by and between the clamp members 28 and 29 of the clamp mechanisms 21 and 22, respectively, of the handling apparatus 20 and removed in an axial direction from the die stem 11. Thereupon, the letting off preventing plates 44 are engaged with the end face of the cleaning ring 13 to push the cleaning ring 13 forwardly from behind, and consequently, an otherwise possible slip of the clamp members 28 is prevented and the burden to the clamps 28 is moderated.

When the cleaning ring 13 is to be clamped, the projection 41 of each of the clamp members 28 is engaged with the circumferential groove 16 of the outer periphery of the cleaning ring 13, and consequently, the cleaning ring 13 can be clamped with certainty by and between the clamp members 28 and failure in clamping can be prevented.

Further, since the circumferential groove 16 is formed in a tapered shape having the inclined faces 18 and 19 on the opposite sides of the bottom 17 thereof while the projection 41 has the inclined faces 42 and 43 corresponding to the inclined faces 18 and 19 of the circumferential groove 16, even if some displacement in the axial direction is present between the circumferential groove 16 and the projection 41, the inclined faces 18 and 19 and the inclined faces 42 and 43 guide each other so that the circumferential groove 16 and the projection 41 can be engaged fully by the clamping force acting between the inclined faces 18, 19 and 42, 43.

As a result, the relative positions between the handling apparatus 20 and the cleaning ring 13 are assured accurately. Therefore, even when shells between the cleaning ring 13 and the loose die 14 are to be ejected after the cleaning ring 13 and the loose die 14 are removed from the die stem 11, such ejection can be performed with certainty.

Figure 7:
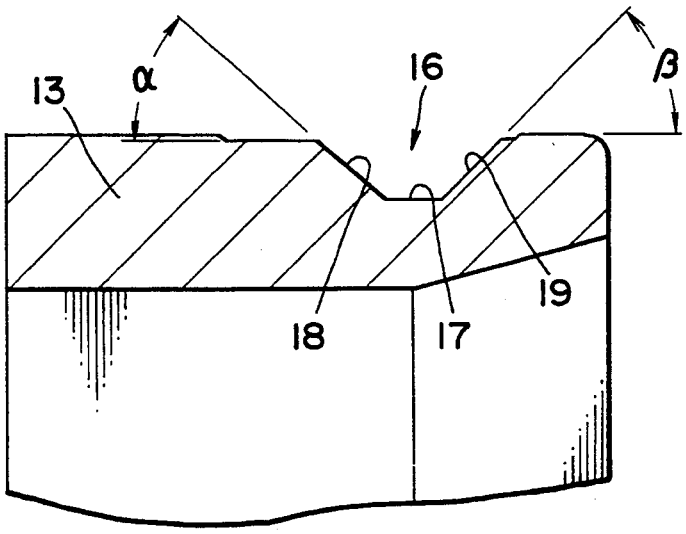
FIG. 7 is a partial sectional view of a cleaning ring showing a second preferred embodiment of the present invention.
Figure 8:
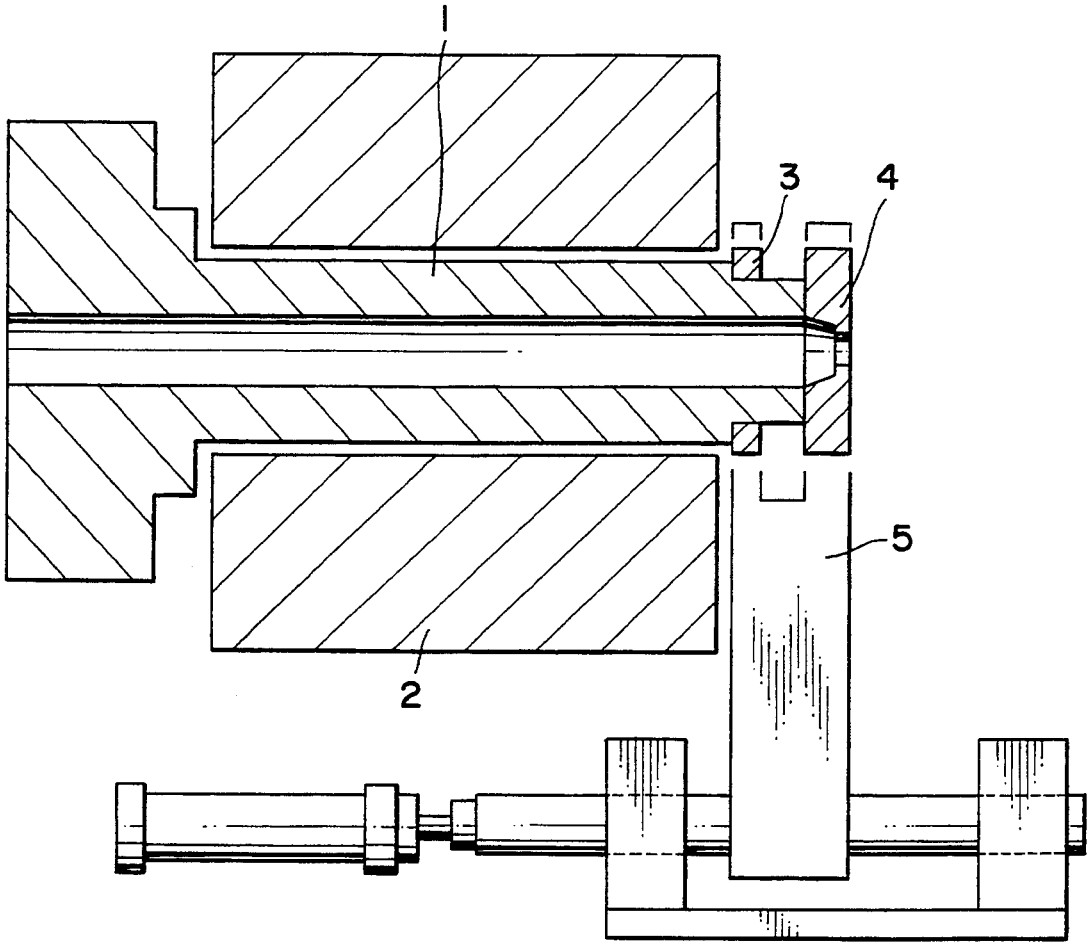
FIG. 8 PRIOR ART
FIG. 8 is a sectional view showing a conventional indirect extrusion press.

Referring now to FIG. 7, there is shown part of an indirect extrusion press according to a second preferred embodiment of the present invention. The indirect extrusion press of the present embodiment is a modification to and is only different from the indirect extrusion press of the preceding embodiment in that the inclination angles $\alpha$ and $\beta$ of the inclined faces 18 and 19 of the circumferential groove 16 of the cleaning ring 13 are both set to 45°. In this instance, also the inclination angles of the inclined faces 42 and 43 of the projection 41 are both set to 45°.

It is to be noted that the projection 41 need not be provided continuously in the circumferential direction of the clamp face 40 but may be provided in several intermittent pieces or provided only by one at a central portion of the clamp face 40 in the circumferential direction.

Further, another circumferential groove may be provided on the outer periphery of the loose die 14 while a projection for engaging the circumferential groove is provided on each of the clamp members 29 of the die clamp mechanism 29.

Having now fully described the invention, it will be apparent to one of ordinary skill in the art that many changes and modifications can be made thereto without departing from the spirit and scope of the invention as set forth herein.

What is claimed is:

1. An indirect extrusion press, comprising:

a die stem:

a container;

a cleaning ring removably fitted at an end portion of said die stem for cleaning the inner face of said container;

a loose die removably mounted at the end of said die stem; and a handling apparatus including first and second pairs of clamp members for clamping therebetween and handling said cleaning ring and said loose die, respectively;

said cleaning ring having a circumferential groove formed on an outer periphery thereof;

each of said first pair of clamp members for clamping said cleaning ring therebetween having a projection formed thereon for engaging said circumferential groove of said cleaning ring, further comprising a letting off preventing plate mounted on a side face of each of said first pair of clamp members remote from said loose die for engaging an end face of said cleaning ring.

2. An indirect extrusion press according to claim 1, wherein a cleaning portion for cleaning the inner face of said container is provided at an end of the outer periphery of said cleaning ring in its axial direction, and said circumferential groove is provided at a position of the outer periphery of said cleaning ring displaced from a central portion in the axial direction opposite to said cleaning portion.

3. An indirect extrusion press according to claim 1, wherein said circumferential groove has a tapered shape having inclined faces on the opposite sides of the bottom thereof.

4. An indirect extrusion press according to claim 1, wherein said projection of each of said clamp members is provided continuously in a circumferential direction of a clamp face thereof.

5. An indirect extrusion press according to claim 1, wherein each of said clamp members is provided with at least one of said projections in a clamp face thereof.

6. An indirect extrusion press, comprising:

a die stem:

a container;

a cleaning ring removably fitted at an end portion of said die stem for cleaning the inner face of said container;

a loose die removably mounted at the end of said die stem; and a handling apparatus including first and second pairs of clamp members for clamping therebetween and handling said cleaning ring and said loose die, respectively;

said cleaning ring having a circumferential groove formed on an outer periphery thereof;

each of said first pair of clamp members for clamping said cleaning ring therebetween having a projection formed thereon for engaging said circumferential groove of said cleaning ring, wherein a cleaning portion for cleaning the inner face of said container is provided at an end of the outer periphery of said cleaning ring in its axial direction, and said circumferential groove is provided at a position of the outer periphery of said cleaning ring displaced from a central portion in the axial direction opposite to said cleaning portion.

* * * * *